United States Patent [19]

McClain

[11] Patent Number: 4,621,475

[45] Date of Patent: Nov. 11, 1986

[54] STRUCTURAL STRUT AND TRUSS FORMED THEREFROM

[75] Inventor: Robert W. McClain, Dallas, Tex.

[73] Assignee: Glitsch, Inc., Dallas, Tex.

[21] Appl. No.: 406,559

[22] Filed: Aug. 9, 1982

[51] Int. Cl.[4] ..... E04C 3/02

[52] U.S. Cl. ..... 52/693; 52/694; 52/729; 52/738

[58] Field of Search ..... 52/693, 694, 639, 690, 52/655, 657, 729, 317, 741, 738; 29/155 R; 228/173 C, 173 D, 182

[56] References Cited

U.S. PATENT DOCUMENTS

| | | | |
|---|---|---|---|
| 159,194 | 1/1875 | Lowthorp | 52/693 |
| 573,151 | 12/1896 | Johnson | 52/693 |
| 1,405,889 | 2/1922 | Barling | 52/693 |
| 1,799,337 | 4/1931 | Warhus | 52/634 |
| 1,880,478 | 10/1932 | Ragsdale | 52/694 |
| 2,156,818 | 9/1936 | Ropp | 52/693 |
| 2,166,658 | 7/1939 | Ford | 52/693 X |
| 2,308,565 | 1/1943 | Mitchell | 52/693 X |
| 2,405,917 | 8/1946 | Watter | 52/693 |
| 2,514,607 | 7/1950 | McLean | 52/693 X |
| 2,860,743 | 11/1958 | Cliff | 52/693 X |
| 3,152,671 | 10/1964 | Mallory, Jr. | 52/693 X |
| 3,328,931 | 7/1967 | Smith | 52/729 X |
| 3,334,461 | 8/1967 | York | 52/693 X |
| 3,353,320 | 11/1967 | Grasis | 52/693 |
| 3,656,270 | 4/1972 | Phillips | 52/693 |
| 3,882,653 | 5/1975 | Ollman | 52/694 |
| 4,062,167 | 12/1977 | Gilb | 52/693 |
| 4,348,850 | 9/1982 | Reeder et al. | 52/693 |

FOREIGN PATENT DOCUMENTS

| | | | |
|---|---|---|---|
| 251453 | 10/1912 | Fed. Rep. of Germany | 29/155 R |

*Primary Examiner*—Alfred C. Perham
*Assistant Examiner*—Jean M. LaKemper
*Attorney, Agent, or Firm*—Thomas L. Cantrell; Stanley R. Moore

[57] ABSTRACT

A structural strut having at least one surface of generally U-shaped cross section and being formed with a pair of upstanding side walls having opposed tapers. The side wall tapers of the strut shift or skew the neutral axis of the member in proportion to the relative side wall dimensions. In this manner, the strut may be used to comprise a load bearing member having a neutral axis selectively slanted to a position maximizing structural loading efficiency and interconnection. The ends of the strut are further formed of substantially planar construction for flat abutment and welded attachment to cross members of a truss thereby eliminating conventional gusset plates. The structural strut may also be constructed from a pair of such U-shaped channel sections secured back-to-back with the tapering flanges complementally positioned opposite one another for selectively shifting the neutral axis of the resulting I-beam. In this manner, the strut beams of the invention present their respective neutral axes in the most advantageous configuration for maximum structural integrity and efficient interconnection.

14 Claims, 8 Drawing Figures

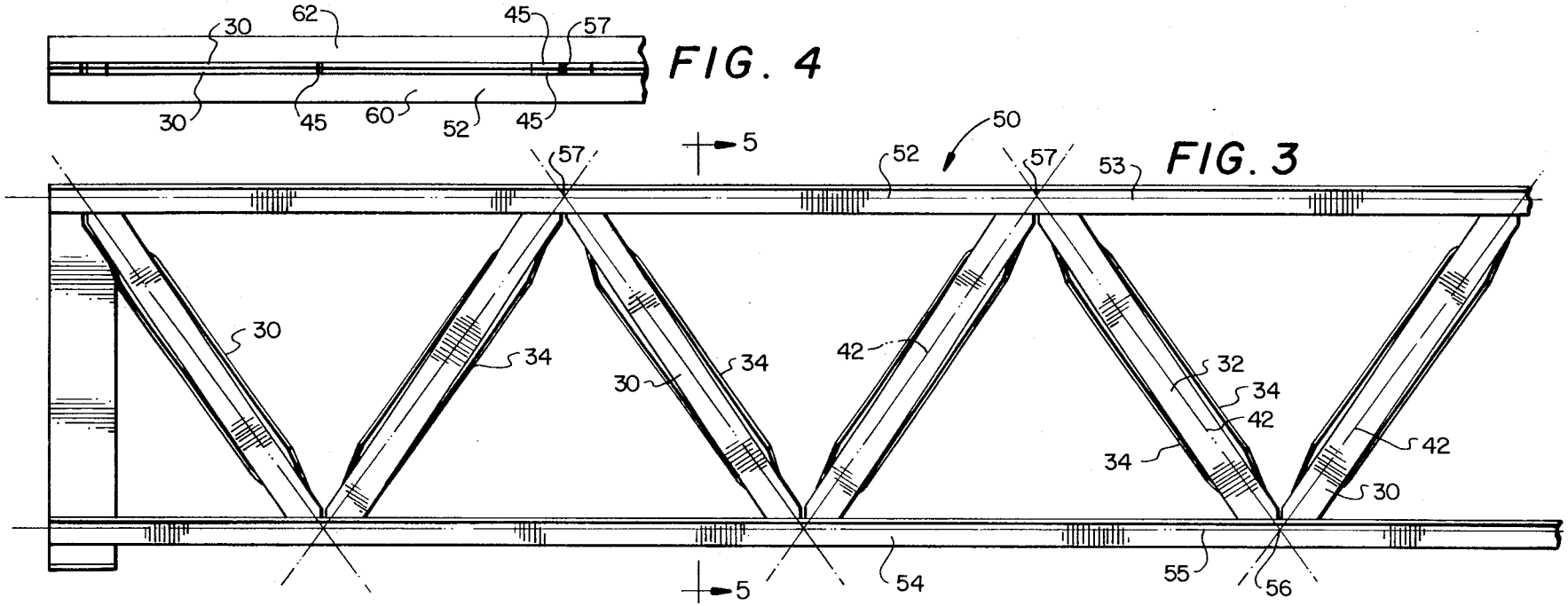
FIG. 3
FIG. 4
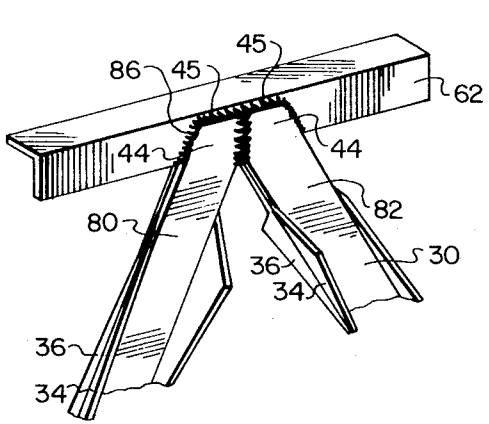
FIG. 7
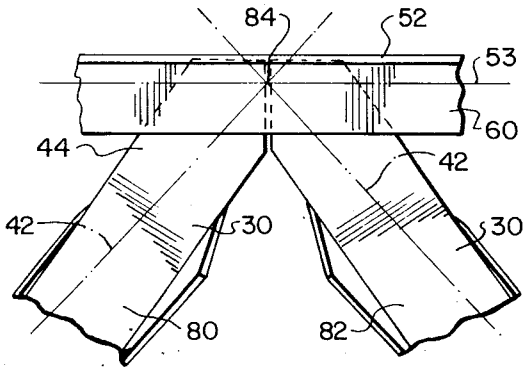
FIG. 6
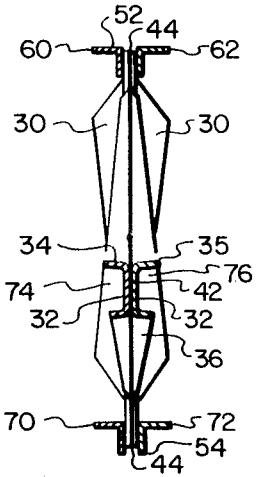
FIG. 5

STRUCTURAL STRUT AND TRUSS FORMED THEREFROM

BACKGROUND OF THE INVENTION

The invention relates to a structural strut, and, more particularly, to a structural load bearing beam or strut having a U-shaped surface including upstanding side walls comprised of opposed tapers for selectively shifting the neutral axis of the beam and facilitating maximum structural efficiency. It further relates to trusses and similar structures formed of such struts or beams.

Heretofore, structural assemblies such as girders, trusses and lattice beams have been constructed from structural struts of conventional design by welding, riveting and the like. Strut and chord elements have been used which have conventional cross sectional shapes in most prior art constructions. These prior art configurations comprise, in the main, L-shaped members, U-shaped channels, and I-beams, each having generally uniform flange and web configurations along the length thereof. The connection points of the terminal ends of these members with transverse chord members of a truss are, however, very limited. Generally, there is not sufficient cross-sectional area for member connection without the use of "gusset plates" of the type now used in conventional trusses. The yield strength of such component members and assemblies is also known to be limited by the material and shapes of the conventional component flanges in the respective planes of bending thereacross.

Conventional structural members illustrating prior art features of structural strut configurations, as well as various truss and girder assemblies, are set forth and shown in the following patents:

| | | |
|---|---|---|
| 573,151 | P. Johnson | Dec. 15, 1896 |
| 2,156,818 | F. N. Ropp | May 2, 1939 |
| 2,308,565 | H. L. Mitchell | Jan 19, 1943 |
| 2,405,917 | M. Watter | Aug. 13, 1946 |
| 3,334,461 | F. L. York | Aug. 8, 1967 |
| 3,353,320 | A. R. Grasis | Nov. 21, 1967 |
| 3,656,270 | Boris Phillips | Apr. 18, 1972 |
| 4,062,167 | Tyrell T. Gilb | Dec. 13, 1977 |

Structural struts are used as braces in the fabrication of buildings, bridges, trusses, and the like. One of the most common brace or truss configurations is comprised of horizontally disposed top and bottom chords having a plurality of strut sections angularly secured there between. In one conventional embodiment of a building construction, the top chord supports a roof structure with the bottom chord supporting a ceiling. Such truss configurations may, however, also be utilized as bridges, ramps, and shelves in both horizontal and vertical configurations for affording the same structural integrity in the associated structure. Trusses are also employed as tray supporting structures inside vapor-liquid contact towers of the kind employed in the chemical and petroleum processing industries.

In conventional horizontal truss configurations, the combined stress through a section of the upper chord is the sum of compression stresses caused by truss action and a bending stress attributable to loading between support points. The total or combined stress to a section of a lower chord is the sum of tension stress caused by truss action and a bending stress caused by the load between the support points. It may thus be seen that the top chord is in compression while the bottom chord is in tension in most horizontal configurations. The angularly disposed strut members, therebetween then distribute these loads and provide structural integrity therethrough. The angular position of the particular strut members as well as the cross sectional configuration thereof establishes the loading parameters and capabilities of the associated assembly.

The strut or brace members utilized between elongated chord elements of a truss assembly are conventionally fabricated along well defined standards. The technology of such strut designs includes a portion of the study of the mechanics of solids. Within this field of study, various parameters are defined and go into the analysis and design of strut and truss configurations. One such parameter is "neutral axis" which is simply a zone of zero stress or strain as well as being the centroid or center of gravity of an elongated member which is subject to bending loads. In a symmetrical member, such as a U-shaped channel of conventional design, the neutral axis lies along the center of the channel. In an L-shaped angle member, the neutral axis lies toward the orthogonal or L-shaped side wall thereof. The neutral axis is in essence shifted by the presence of the upstanding wall, or flange. In a conventional truss construction, it is considered good design practice to arrange chords and struts so that at joints the neutral axes of the several members forming the joint intersect at a point, or form the smallest practical triangle as approximation of a point intersection. Conventional struts in truss constructions achieve or approach this result by providing a sufficiently wide strut and chord sections as well as connection plates for attachment to the sections.

Conventional truss designs incorporate load bearing members with large attachment areas for securement to intersecting chord members and/or adjacent struts. Very often "gusset" plates are utilized for providing the requisite surface area and weld regions for structurally sound interconnection. The utilization of gusset plates is an additional expense in material and labor and an added weight factor. The position of the neutral axis within the individual struts is likewise a consideration in the over all design of the structure. Conventional channels and I-beam members having centrally aligned neutral axes do not lend themselves to angulated interconnection, in a close spacing where the lateral flanges interfere with one another. The most predominant problem is the parallel relationship between the neutral axis of the strut and the upstanding flange of the U-channel or I-beam which necessitates increased chord width and/or gusset plates for structural interconnection across the intersection of the neutral axes. Additionally, strut loading requires a specifically definable bending strength which may not be uniform along the whole length of the strut due to variations of loading cross the truss. For this reason, struts of uniform cross section often present added weight to a lattice beam structure by supplying unnecessary strength and material in areas of relatively low loading. One problem aggravates the other in such designs because excess weight necessitates increased beam strength.

It would be an advantage, therefore, to overcome the problems of the prior art by providing a strut having the requisite bending strength with a minimum of material and in a configuration affording maximum strength through interconnection in a minimum of space. Such a method and apparatus is provided in the present invention wherein a strut and method of manufacture is disclosed having at least one surface of U-shaped cross section and flanges formed with opposing tapers. The maximum height of each flange is determined by the maximum bending strength necessary for the particular loading configuration in that area of the strut. By reducing the height of the upstanding side wall section adjacent that portion of the strut, the neutral axis extending therethrough is shifted toward the side of the strut having the proportionally greater flange region. This shifting relationship propogates along the strut as the wider wall section tapers downwardly and the smaller wall section tapers upwardly. This opposing flange taper functionally shifts the neutral axis along a straight line extending between said walls whereby the strut can be secured at opposite ends in a minimum of space and with precise intersection of neutral axes. Material and weight is saved by forming each end of the strut of the present invention with a flat web surface area in a shape facilitating mating abutment and welding one to another and to an associated chord member.

SUMMARY OF THE INVENTION

The present invention relates to a structural strut, trusses and beams formed from such struts. More particularly, the present invention relates to a strut having a generally U-shaped surface of opposed side wall flanges formed with opposing tapers for shifting the neutral axis lying therebetween. The generally U-shaped section is formed from sidewall flanges extending along an intermediate web or body region and the improvement comprises first and second flanges constructed with opposed sloping surfaces relative to the intermediate region of the strut. The sloping flanges slant the neutral axis therebetween toward the side of the strut having the greatest flange area at any particular point along the strut. Opposed terminal ends are constructed on the strut with substantially flat web portions for engagement with mating structural members.

In another aspect, the invention includes a truss comprising upper and lower flanged chord members each having a neutral axis. A plurality of strut members extend between and are attached to the upper and lower chord members. The struts each have an elongated web, opposite ends of which are in abutting attachment with the chord members. The struts also have flanges of opposed tapered heights at opposite sides of the web. The tapered flanges skew the neutral axis of each strut to facilitate point intersection of the neutral axis of the adjacent struts and an attached chord member.

In another aspect, the flanges of the strut of the present invention extend for a distance less than the length of the web to provide a flange-free area on the web at each end. This feature facilitates the positioning of adjacent struts substantially contiguous one another and securement thereto by welding, or the like. The end faces of the web may also be angulated relative to the side faces of the strut and orthogonal one to the other for engagement with and securement to transverse chord members.

In yet another embodiment, the strut of the present invention may be constructed with a pair of generally planar elongate webs secured one to the other in back-to-back relationship. Each web includes a pair of upstanding flanges at opposite sides thereof. The flanges are of tapered height and of opposed slants to skew the neutral axis of the strut with respect to the geometric axis of the webs. The paired web construction can also be used in truss assemblies with flange-free terminal areas facilitating securement to transverse chord members. In this manner strut and truss assemblies of a wide variety of designs can be provided for low cost materials in a light-weight high-strength configuration.

BRIEF DESCRIPTION OF THE DRAWINGS

For a more complete understanding of the present invention and for further objects and advantages thereof, reference may now be had to the following description taken in conjunction with the accompanying drawings, in which:

FIG. 3 is a side elevational view of one embodiment of a lattice beam or truss constructed in accordance with the principles of the invention and utilizing the structural struts of FIG. 2;

FIG. 4 is a fragmentary top plan view of the lattice beam of FIG. 3;

FIG. 5 is an end elevational cross sectional view of the lattice beam of FIG. 3, the section being taken along lines 5—5 thereof and illustrating one method of forming an I-beam strut in accordance with the principles of the present invention;

FIG. 6 is an enlarged side elevational fragmentary view of one area of the lattice beam of FIG. 3 illustrating the interconnection of adjacent strut members and an upper horizontal chord member;

FIG. 7 an enlarged perspective fragmentary view of the lattice beam assembly of FIG. 6 with one chord member removed from the view for purposes of clarity of illustration.

DETAILED DESCRIPTION

Figure 1:
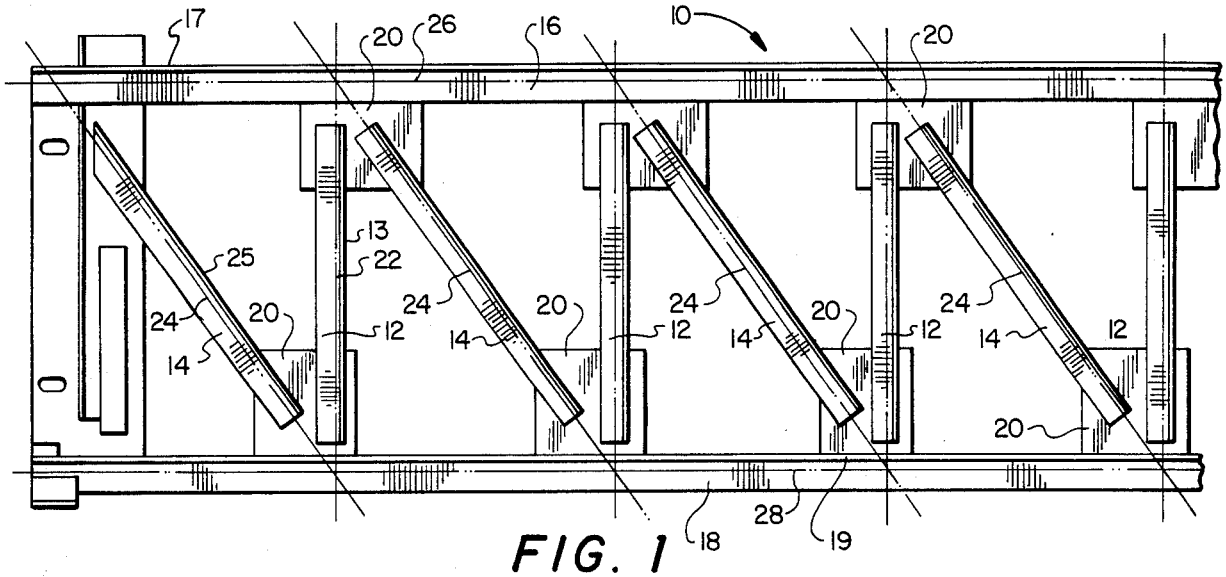
FIG. 1 (PRIOR ART)
FIG. 1 is a side elevational view of one embodiment of a prior art lattice beam constructed in accordance with conventional strut and chord designs.

Referring first to FIG. 1, there is shown one embodiment of a prior art lattice beam assembly 10. The lattice beam 10 is conventionally referred to as a Pratt-type and is one in which a series of vertical struts 12 are connected by a series of generally parallel, load bearing, angulated struts 14 positioned therebetween. An upper chord member 16 is positioned in generally parallel relationship to a lower chord member 18. The chord members 16 and 18 are connected structurally to the struts 12 and 14 through gusset plates 20 secured at the intersections thereof by welding or the like. The gusset plates 20 have been found necessary in this form of truss in order to provide adequate abutment area and welding edge length and to make possible alignment of parts so that the neutral axes intersect at a point as is shown in FIG. 1. The various components of the lattice beam 10, including the struts 12 and 14 and chords 16 and 18, are generally formed of conventional L-shaped angle which are welded individually to the respective gusset plates sandwiched therebetween. This particular lattice beam configuration has been utilized for many years. One obvious drawback of the assembly 10 of FIG. 1 is, however, the added weight, cost and spacing of the struts and of the gusset plates 20. It may likewise be seen that the various components are spaced one from the other and secured one unto the other only through the gusset plates because of the respective positioning necessary for intersection of the several neutral axes of the elements at a point.

Still referring to FIG. 1, strut 14 is shown with a neutral axis 24 extending therealong near the flange 25 and in generally spaced parallel relationship thereto. Likewise, neutral axis 22 is shown extending along strut 12 in a position shifted toward flange 13 in generally spaced parallel relationship. A neutral axis 26 extends along upper chord 16 adjacent or near flange 17 in spaced parallel relationship. A neutral axis 28 is next seen to be shifted toward flange 19 of lower chord 18. The neutral axis 28 is seen to intersect neutral axis 22 and 24 of struts 12 and 14, respectively, at a point. Neutral axis 26 of upper cord 16 is likewise seen to intersect neutral axis 22 and 24 of struts 12 and 14 at a point. The point intersection of these respective neutral axes is made possible only through the placement and welded securement of the gusset plates 20. It would thus be an obvious advantage to provide the several structural elements of the truss in a configuration affording interconnection without the use of gusset plates 20. However, it can easily be seen that an extension of the struts 12 and 14 toward the respective points of intersection would be prohibited by the "flanged" profiles of the individual members. Such a configuration is, in essence, prohibited or made impractical by mutual interferences of the flanges. The feature of mutual interference would become even more complex in a lattice beam construction of the Warren type wherein the struts are angulated one toward the other between parallel chord members. The structure of the present invention affords elimination of both the gusset plates and the mutual interference patterns of struts and chords by selectively angulating the neutral axes within each strut and forming the ends thereof in a generally flat web of a mating configuration for engagement with adjacent struts and the associated chord member.

Figure 2:
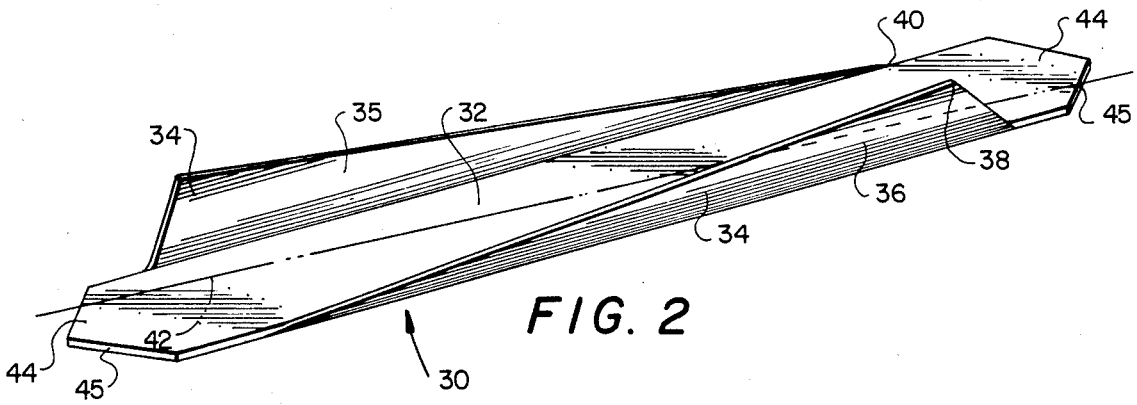
FIG. 2 is an enlarged perspective view of one embodiment of a structural strut constructed in accordance with the principles of the present invention.

Referring now to FIG. 2, there is shown a structural strut 30 constructed in accordance with the principles of the present invention. The strut 30 consists of an elongate, intermediate body portion or web 32 extending between two upstanding side walls, or flanges, 34. A first flange 35 upstands from body portion 32 with a downwardly extending taper which progresses from one end of the flange to the other. A second complemental flange 36 likewise tapers along the length of strut 30 in a reverse direction, whereby the tapers are opposed and comprise the reverse image of one another. The strut 30 may be formed from sheet metal by bending the flanges 34 relative to the body 32 with conventional methods and apparatus. In this manner, specific strut patterns may be produced in accordance with particular applications. For example, each end of the strut 30 may be seen to be formed with a flat web portion 44 for facilitating flat abutment and structural engagement with a mating member. Likewise the end 45 of the web 44 comprises a slope facilitating the angular placement upon mating structural elements. The neutral axis of the strut 30 is slanted or sleeved relative to sloping flanges 35 and 36 from one longitudinal side of the strut 30 to the other. The neutral axis 42 thus extends somewhat diagonally from opposite portions of the terminal ends 45 of the strut 30 in a manner facilitating point intersection with neutral axes adjacent structural struts and connecting chord members as is defined in more detail below.

Referring now to FIG. 3, there is shown a lattice beam construction of the Warren type. The lattice beam 50 comprises a plurality of struts 30 angulated with respect to one another. The struts 30 are each constructed with opposed sloping flanges 34 for selectively shifting the neutral axis 42 of each strut to facilitate interengagement with upper and lower chord members 52 and 54, respectively. In the present embodiment, the generally horizontal chord members are usually constructed from L-shaped angle members, the neutral axes of which are shifted from the visually central portions thereof as viewed in side elevational, and/or top plan, views.

Upper chord member 52 thus includes a neutral axis 53 which intersects the neutral axes 42—42 of intersecting struts 30—30 at intersection point 57. Lower chord member 54 includes neutral axis 55 which intersects the neutral axes 42—42 of intersecting struts 30—30 at point 56. The angulated neutral axes 42—42 may be seen to facilitate the relatively close spacing of the respective struts and chord members as compared to the prior art of FIG. 1. Likewise, the positioning of the respective intersection points 56 and 57 of the neutral axes of the respective members is greatly simplified. This configuration affords maximum structural integrity with a minimum of excess spacing, material, weight and welding. The resulting lattice beam 50 is thus provided in a configuration of comparatively lighter weight and fewer parts necessitating fewer welds and less cost.

Referring now to FIG. 4, there is shown a top plan, fragmentary view of the lattice beam 50 of FIG. 3. The top chord member 52 is thus shown to be formed of two L-shaped, juxtaposed chord members comprising angle sections 60 and 62 sandwiching therebetween the respective struts 30 which are matingly secured by welding, or the like, at intersection 57. In this top plan view, only the terminal ends 45 of the struts 30 are shown in sandwiched connection with the chord member 60 and 62. In this particular embodiment, the struts 30 are provided in a paired assembly which is welded back-to-back to comprise a generally "I" shaped cross section. The tapering flanges 34 are assembled in the complementary fashion for matingly engaging and concomitantly shifting the common neutral axis 42 of the resultant I-beam in the manner described above. It may thus be seen that the strut 30 may be utilized individually as a U-channel member or in welded pairs as an I-beam.

Referring now to FIG. 5, there is shown an end elevational, cross sectional view of the lattice beam structure 50 of FIG. 3 taken along lines 5—5 thereof. The upper chord member 52 is shown in an end-elevational, cross-sectional view with L-shaped chord members 60 and 62 sandwiching a back-to-back pair of structural struts 30 therebetween. In similar fashion, lower chord member 54 is comprised of first and second L-shaped members 70 and 72, respectively, which sandwich first and second struts 74 and 76 therebetween. Struts 74 and 76 may be seen to be welded together back-to-back along the juxtaposed intermediate body portion 32 of each with the side wall flanges 34 of each outstanding therefrom. In the particular section shown, flange 35 is of greater width than flange 36 and the neutral axis 42 lies nearer the flange 35 as shown in FIG. 5. It may be seen that the back-to-back abutment and assembly of struts 30, one to the other, provides a generally I-shaped structural member with the "I" flanges tapering symmetrically about the joinder, or center line, of the two struts 30. In this manner, the neutral axis 42 of the combined beam is shifted as set forth and described in FIG. 2.

Referring now to FIG. 6, there is shown an enlarged side elevational view of the assembly of the struts 30 with upper chord member 52. It is important to note that the stress concentration at the intersection of the struts 30 is a critical feature of such assemblies and must be addressed. Consistent therewith, a first 'I'-shaped strut 80 is shown in angular engagement with chord member 52 adjacent a second, angulated 'I'-shaped strut 82. The respective slanting neutral axes 42—42 of the struts 80 and 82 are shown to intersect at point 84 along neutral axis 53 of chord 52. The gap between adjacent struts 80 and 82 is also shown to be limited to approximately the thickness of one strut, wherein the end faces of the struts may be said to be immediately adjacent. In this manner, the facing edges of adjacent struts can be welded over to further secure the assembly and relieve the stress concentration which would form at the intersection 84 if a larger gap existed. This condition could be critical and cause the resulting stress at such a gap to exceed the yield strength at the designed load. Maximum structural integrity is thus provided in the present invention by the intersection of the neutral axes, narrow spacing of immediately adjacent strut end faces, and the aforesaid welding of the flat web portions 44 to each other and the chord member.

Referring now to FIG. 7, there is shown a fragmentary perspective view of the structural strut chord assembly of FIG. 6 with outer chord member 60 removed for purposes of clarity of illustration. 'I'-shaped strut 82 is thus shown to be angularly oriented relative to chord member 62 adjacent angularly disposed 'I'-shaped strut 80. The web region 44 may be seen to be formed in the necessary shape for permitting ends 45 to be adjacent one another in welded side-by-side relationship along chord member 62 for securement thereto. This shape will of course vary depending on the angle of the struts 30 in the lattice beam. A weld filet 86 is next shown to extend around the web region 44 and between struts 30 for securing the strut beams 80 and 82 to the chord member 62. The symmetrical positioning of the respective flanges 34 which are juxtaposed edge-to-edge on each 'I'-shaped strut is likewise illustrated in this perspective diagram.

Figure 8:
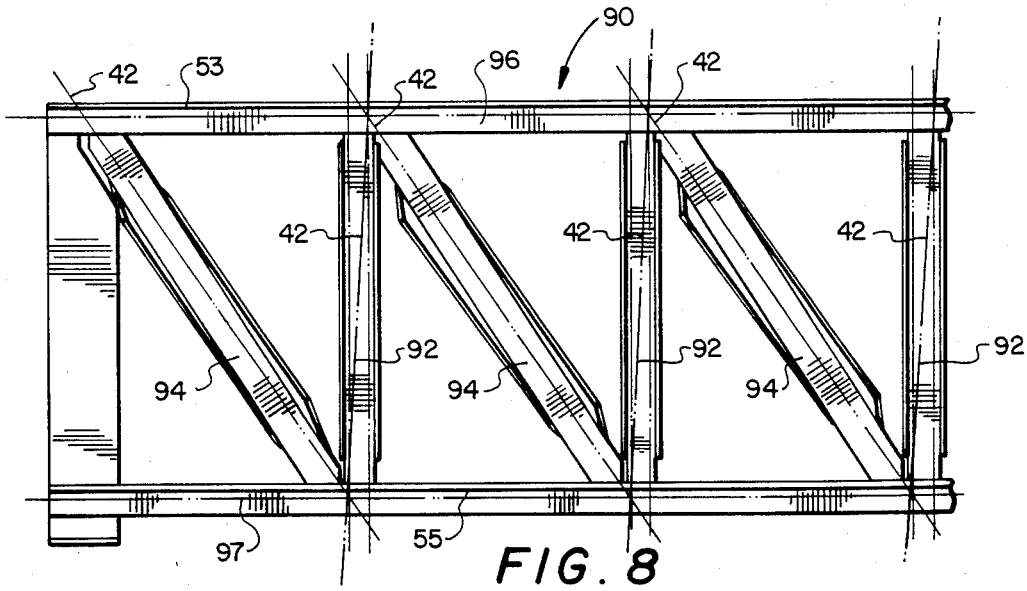
FIG. 8 is a side elevational view of an alternative embodiment of a lattice beam or truss constructed in accordance with the principles of the present invention.

Referring now to FIG. 8, there is shown a Pratt type lattice beam constructed in accordance with the principles of the present invention. Lattice beam 90 is thus shown constructed from vertical struts 92 with angulated struts 94 secured therebetween. The neutral axes 42 of the respective struts 92 and 94 are skewed for affording the advantageous point intersections thereof along the upper chord member 96 and lower chord member 97. It may be seen that the struts 92 and 94 are similar in construction to strut 30 of FIG. 2 except for the shape of the web area 44 at the terminal ends 45 which is contured for mating engagement at the respective upper and lower chord members 96 and 97. The angulated neutral axes 42 thus facilitate the construction of this alternative embodiment, particularly in conjunction with the flat terminal end web 44 of the struts of the present invention, the two features together making possible the elimination of gusset plates. It should also be noted that other lattice beam configurations of conventional design may utilize the principles of the present invention to provide a truss structure having strut interconnection affording maximum structural integrity with a minimum of weight.

It is thus believed that the operation and construction of the present invention will be apparent from the foregoing description. While the apparatus as shown and described has been characterized as being preferred it will be obvious that various changes and modifications may be made therein without departing from the spirit and scope of the invention as defined in the following claims.

I claim:

1. A structural strut comprising:

a generally planar elongated web having frontal and back surfaces and a pair of generally parallel upstanding flanges laterally disposed along opposite sides thereof, said flanges being of tapered height and of opposed tapers, each flange extending outwardly of said web along said frontal surface thereof substantially in a single tapered slant which is opposite to said other flange to thereby skew the neutral axis of said strut with respect to the geometric axis of said web;

said flanges extending for a distance less than the length of said web with coplanar flange-free areas formed on the web at each and thereof to facilitate coplanar attachment of said strut to other structural members in generally angular engagement therewith;

said coplanar flange-free areas on said web including angulated end faces, said angulated end faces being adapted for mating angulated engagement with said structural menbers; and said angulated end faces being formed at an angle relative to said sides of said web and orthogonal one to the other for facilitating angulated attachment of said strut to said structural members and immediately adjacent one another.

2. A strut constructed in accordance with claim 1 wherein said opposed tapers of said flanges include first, elongated tapers substantially along the length of said web and a second, relatively sheer taper adjacent to and defining one section of said flange-free area.

3. A structural strut comprising:

a pair of generally planar elongated webs, each web having frontal and back surfaces, secured one to the other in back-to-back relationship, with each web having a pair of generally parallel upstanding flanges laterally disposed along opposite sides thereof, said flanges being of tapered height and of opposed slants, each flange extending outwardly of said web along said frontal surface thereof substantially in a single tapered slant which is opposite to said other flange to thereby skew the neutral axis of said strut with respect to the geometric axis of said webs; and said flanges extending for a distance less than the length of said webs with coplanar flange-free areas formed on the webs at each end thereof to facilitate coplanar attachment of said strut to other structural members in generally angular engagement therewith.

4. A strut constructed in accordance with claim 3 wherein said coplanar flange-free areas on the webs include angulated end faces, said angulated end faces being adapted for mating angulated engagement with said structural members.

5. A strut constructed in accordance with claim 4 wherein said angulated end faces are formed at angle relative to said sides of said web and orthogonal one to the other for facilitating angulated attachment of said strut to said structural members and imediately adjacent one another.

6. A strut constructed to accordance with claim 3 wherein said opposed tapers of said flanges of said webs include first, elongated tapers substantially along the length of said web and a second, relatively sheer taper adjacent to and defining one section of said coplanar flange-free area.

7. A truss comprising:

an upper flanged chord member having a neutral axis;

a lower flanged chord member having a neutral axis, said upper and lower chord members lying in and defining a primary plane of said truss;

a plurality of strut members extending between and attached to said upper and lower chord members, said struts each having a generally planar elongated web having frontal and back surfaces, opposite ends of which are in generally coplanar attachment with said flanged chord members, and further having flanges of opposed tapered heights, each flange extending outwardly of said web from said frontal surface thereof substantially in a single tapered slant which is opposite to said other flange, said flange being laterally disposed along opposite sides of said web to thereby skew the neutral axis of each strut with respect to the geometric axis of said web to facilitate point intersection of the neutral axis of adjacent struts and an attached chord member;

said flanges of all of said chords and struts extending outwardly and generally transverse to said primary plane of said truss; and said flanges of said struts extending a distance less than the length of said webs with coplanar flange-free area formed on said webs at each end thereof to facilitate coplanar attachment of said struts to said flanged chord members in generally angular engagement therewith.

8. A truss constructed in accordance with claim 7 wherein said coplanar flange-free areas on said webs include angulated end faces adapted for mating angulated engagement with said flanged chord members.

9. A truss constructed in accordance with claim 8 wherein said angulated end faces are formed at an angle to said sides of said web and orthogonal to one another for facilitating angulated attachment of said strut to said structural members and immediately adjacent one another.

10. A truss constructed in accordance with claim 7 wherein said opposed tapers of said flanges of said struts include first, elongated tapers substantially along the length of said webs and a second; relatively sheer taper adjacent to and defining one section of said flange-free area.

11. A truss comprising:

a pair of upper flanged chord members secured one to the other in back-to-back relationship having a common neutral axis;

a pair of lower flanged chord members secured one to the other in back-to-back relationship and having a common neutral axis, said upper and lower chord members lying in and defining a primary plane of said truss;

a plurality of strut members extending between and attached to said upper and lower chord members, said struts each comprising a pair of generally planar elongated webs, each web having frontal and back surfaces, secured one to the other in back-to-back relationship with opposite ends thereof being in generally coplanar attachment with said flanged chord members, and further having flanges of tapered height and of opposed slant each flange extending outwardly of said web along said frontal surface thereof substantially in a single tapered slant which is opposite to said other flange, said flanges being disposed along opposite sides of said web to thereby skew the neutral axis of said struts with respect to the geometric axis of said web to facilitate point intersection of the nuetral axis of adjacent struts and said attached chord;

said flanges of said chords and struts extending generally transversely to said primary plane of said truss; and said flanges of said struts extending for a distance less than the length of said webs with coplanar flange-free areas formed on the webs at each end thereof to facilitate coplanar attachment of the strut to said flanged chord members in generally angular engagement therewith.

12. A strut constructed in accordance with claim 11 wherein said coplanar flange-free areas on the webs include angulated end faces, said angulated end faces being adapted for mating angulated engagement with said flanged chord members.

13. A strut constructed in accordance with claim 12 wherein said angulated end faces are formed at an angle relative to said sides of said web and orthogonal to one another for facilitating angulated attachment of said strut to said structural members and immediately adjacent one another.

14. A strut constructed in accordance with claim 13 wherein said opposed tapers of said flanges of said webs include first elongated tapers substantially along the length of said web and a second, relatively sheer taper adjacent to and defining one section of said flange-free area.

* * * * *